US006036794A

United States Patent [19]

Doris, Jr. et al.

[11] Patent Number: 6,036,794

[45] Date of Patent: Mar. 14, 2000

[54] IGNITER COMPOSITION

[75] Inventors: Thomas A. Doris, Jr., Sparta, N.J.; Kevin D. Vest, Pleasant Hill, Mo.

[73] Assignee: The United States of America as represented by the Secretary of the Army, Washington, D.C.

[21] Appl. No.: 09/054,318

[22] Filed: Mar. 31, 1998

[51] Int. Cl.[7] ..... C06B 45/10; C06B 45/02; C06B 33/00; C06B 33/02; D03D 23/00

[52] U.S. Cl. ..... 149/19.4; 149/21; 149/37; 149/44; 149/108.6; 149/109.6

[58] Field of Search ..... 149/19.4, 37, 44, 149/21, 5, 108.6, 109.6; 102/205

[56] References Cited

U.S. PATENT DOCUMENTS

| | | | |
|---|---|---|---|
| 3,983,818 | 10/1976 | Ciccone et al. | 102/60 |
| 4,138,282 | 2/1979 | Goddard et al. | 149/19.8 |
| 4,363,679 | 12/1982 | Hagel et al. | 149/37 |
| 4,597,810 | 7/1986 | Trickel et al. | 149/15 |
| 4,608,102 | 8/1986 | Krampen et al. | 149/92 |
| 5,639,984 | 6/1997 | Nielson | 102/336 |
| 5,811,724 | 9/1998 | Henry, III et al. | 149/18 |

*Primary Examiner*—Charles T. Jordan
*Assistant Examiner*—Aileen J. Baker
*Attorney, Agent, or Firm*—John Francis Moran

[57] ABSTRACT

An igniter composition, and a method of manufacturing the igniter composition, comprised of an oxidizer dispersed in polyurethane resin using anhydrous acetone as a solvent. The polyurethane resin is cured at room temperature and granulated to form a granulated igniter. The granulated igniter may be blended with powdered magnesium. Preferably, the oxidizer is strontium peroxide and the amount of polyurethane resin is approximately 10 to 14 parts by weight and the amount of strontium peroxide is approximately 90 to 86 parts by weight, the ideal mixture is 12 part by weight polyurethane resin and 88 parts by weight strontium peroxide.

14 Claims, No Drawings

IGNITER COMPOSITION

U.S. GOVERNMENT INTEREST

The invention described herein may be manufactured, used and licensed by or for the U.S. Government for U.S. Government purposes.

FIELD OF THE INVENTION

The present invention relates to igniter compositions used with pyrotechnics. More specifically, the present invention relates to an igniter composition comprised of an oxidizer dispersed in polyurethane resin used with small arms pyrotechnic compositions for tracer rounds.

BACKGROUND OF THE INVENTION

Igniter compositions are often used with pyrotechnic compositions in, for example, in small arms tracer rounds. Tracer rounds are typically distributed between intervening non-tracer rounds in a weapon's magazine to allow visual tracking of small arms fire. When a tracer round is fired from a weapon, the igniter composition ignites the pyrotechnic composition leaving a trail, or trace, of the projectile's path. This allows for adjustment of fire to intercept the intended target.

Presently, many Department of Defense small arms pyrotechnic compositions use igniters that require the use of methyl-chloroform (1, 1, 1 trichloroethane) in their manufacture such as I-136, I-194, and I-280 igniters. (I-280 is a mixture of 15% magnesium and 85% I-136). For example, the I-136 igniter comprises a mixture of 90% strontium peroxide oxidizer and 10% calcium resinate binder. The calcium resinate must first be solubilized with methyl-chloroform before the addition of the strontium peroxide. The solubilized calcium resinate coats the strontium peroxide on drying and produces a uniform granular mixture that is dense and free flowing. The calcium resinate also imparts a moisture proof barrier effect that protects the underlying tracer mixture that, being high in magnesium powder, is subject to moisture attack causing malfunction.

I-136 is a dim igniter, that is it emits practically no visible light during the initial part of the tracer projectile's trajectory. This prevents a visible signature, or trace, when the projectile is first fired to avoid blinding the gunner and to prevent an enemy from easily observing the gunner's position. I-136 is used in a broad spectrum of small arms ammunition such as 5.56 mm, 7.62 mm. 50 caliber, and 20 mm rounds that incorporate a tracer element. It may also function as a base for other igniters and tracer compositions and with the addition of varying amounts of magnesium it functions as a subigniter and dull igniter.

I-136 has been in use for 60 years and its manufacture originally used carbon tetrachloride to solvate the calcium resinate before mixing with strontium peroxide to produce a uniform, homogeneous, free flowing powder that was ideal for the loading procedure at ammunition plants. In the late 1960's carbon tetrachloride was found to be a carcinogen and methyl-chloroform was then substituted for the carbon tetrachloride.

However, it has been determined that methyl-chloroform depletes the earth's ozone layer, requiring discontinuation of its use. Additionally, methyl-chloroform is a volatile organic compound that requires volatile organic solvents for clean-up of manufacturing spills. Further, the use of methyl-chloroform requires the use of a solvent recovery system to reduce its toxic effects. However, if strontium peroxide and calcium resinate are dry blended without first solubilizing the calcium resinate with methyl-chloroform, the resulting composition does not have the flowability necessary for the projectile charging procedure and is not water resistant to ensure proper performance under adverse moisture conditions. Moreover, the calcium resinate binder is derived from natural sources with varying purity from lot to lot thus making blending of the proper proportions of calcium resinate and strontium peroxide difficult.

Many attempts have been made without success to produce a substitute I-136 dim igniter without the use of carbon tetrachloride or methyl-chloroform solvents. The pharmaceutical industry's methods in blending dissimilar powders, and other fuel-oxidizer systems that do not require a solvent in their blending were investigated. As examples: (1) ethyl cellulose was substituted for the I-136 calcium resinate to produce a mixture of 10% by weight ethyl cellulose and 90% by weight strontium peroxide. One such mixture was dry blended and another was solubilized with isopropyl alcohol. Each was more difficult to ignite and burned with more flame than standard I-136. (2) Substituting gelatin for calcium resinate was ineffective. (3) Substituting melamine for calcium resinate was ineffective producing a composition that was very difficult to ignite. (4) Substituting carboxy methyl cellulose for calcium resinate in a dry blend produced an undesired bright flame. When the carboxy methyl cellulose was first solubilized with water, the resulting composition failed to ignite because, it is believed, the peroxide lost an oxygen and hence its oxidative potency.

Liquid nitrogen and liquid carbon dioxide (as used to decaffeinate coffee) were considered to eliminate the need to use a solvent recovery system to produce a dim igniter with characteristics similar to the I-136. Other alternative solvent systems were investigated. For example the I-136 strontium peroxide/calcium resinate combination were tested using the following solvents: (1) acetone; (2) isopropyl alcohol; and (3) a 50/50 mixture of acetone and isopropyl alcohol. A 95% strontium peroxide and 5% calcium resinate sample was also tested since the NASA thermodynamic code indicates this is the optimum ratio that produces the highest flame temperature. Both fuzed and precipitated calcium resinate were used in these blends due to their different rates of solubility. Each blend was wetted with each solvent, blended with a spatula and dried over a hot plate. The resulting cakes were passed through a 20 mesh sieve and produced more free flowing compositions that were denser than the dry mixed blends. Additionally, 2 grams of calcium resinate were dissolved in 4 cc of 50/50 acetone/isopropyl alcohol by volume to produce a fluid having the same color and apparent thickness as calcium resinate dissolved in 1, 1, 1, trichloroethane.

None of the above attempts resulted in a satisfactory substitute for the I-136 dim igniter composition.

Accordingly, it is an object of the present invention is to provide a dim igniter composition without the use of carbon tetrachloride, methyl-chloroform or other ozone depleting compounds in its manufacture.

Another object of the present invention to provide a dim igniter composition without the use of volatile organic compounds in its manufacture.

A further object of the present invention is to provide a dim igniter composition consisting of components having consistent purity to allow for efficient, accurate, and uniform blending.

Yet another object of the present invention is to provide a dim igniter composition having the physical characteristics amenable to existing charging procedures at munitions loading plants while having similar performance characteristics as the I-136 dim igniter.

Other objects will appear hereinafter.

SUMMARY OF THE INVENTION

It has now been discovered that the above and other objects of the present invention may be accomplished in the following manner. Specifically, the present invention provides a dim igniter composition, and a method of manufacturing the dim igniter composition, comprised of an oxidizer dispersed in polyurethane resin using anhydrous acetone as a solvent. The polyurethane resin is cured, preferably at room temperature, and granulated to form a granulated igniter. The granulated igniter may be blended with powdered magnesium. Preferably, the oxidizer is either strontium peroxide or barium peroxide. The amount of polyurethane resin is approximately 10 to 14 parts by weight and the amount of strontium peroxide is approximately 90 to 86 parts by weight, the ideal mixture is 12 part by weight polyurethane resin and 88 parts by weight strontium peroxide. Approximately 95 parts by weight polyurethane and 5 parts by weight barium peroxide is preferred. The polyurethane resin may be IE 70D™ resin (isocyanate), a two part resin.

DETAILED DESCRIPTION OF THE PREFERRED EMBODIMENT

An oxidizer is dispersed in polyurethane resin to form a dim igniter composition with the desired physical and performance characteristics, i.e. flowability, water resistance, and dim ignition burning. Methyl-chloroform, a volatile organic compound and an ozone depleter which use must cease, is not required as a binder solubilizer in the dim igniter's manufacture.

For example, the Department of Defense I-136 dim igniter comprises strontium peroxide and calcium resinate. The calcium resinate must first be solubilized with methyl-chloroform (1, 1, 1 trichloroethane) before mixing with the strontium peroxide, or else the dry mixed igniter does not have the proper flowability necessary for the tracer round charging procedure and is not water resistant to ensure reliable ignition in adverse moisture conditions. Furthermore, calcium resinate is derived from natural sources with varying purity from lot to lot. This makes production of consistently proportioned amounts of calcium resinate to strontium peroxide difficult, making some batches of strontium peroxide/calcium resinate igniter less effective than other batches due to the inconsistent lot purity of the calcium resinate.

However, it has been discovered that substitution of polyurethane resin for calcium resinate eliminates the necessity of using methyl-chloroform as a solubilizer for the calcium resinate. Instead, strontium peroxide is dispersed in polyurethane resin using anhydrous acetone as a solvent and the resin is then cured, preferably at room temperature. The igniter composition is granulated and may be blended with powdered magnesium. In the preferred embodiment, the igniter comprises approximately 10 to 14 parts by weight of polyurethane resin and approximately 90 to 86 parts by weight of strontium peroxide. The ideal composition has 12 parts by weight of polyurethane resin and 88 parts by weight of strontium peroxide. Further, barium peroxide may be substituted for strontium peroxide in which case the preferred composition comprises approximately 95 parts by weight of polyurethane and 5 parts by weight of barium peroxide. The polyurethane resin may consist of IE 70D™ resin (isocyanate) manufactured by Innovative Engineering of 1541 West Round Lake Road, DeWitt, Mich. 48820.

Comparative tests were conducted for many of the compositions described below with the results of those tests summarized hereinafter. A baseline for testing the igniter composition of the present invention was established using a standard I-136 prepared by Lake City AAP. Flow and burning characteristics of the I-136 igniter were noted. The I-136 igniter standard was manufactured using 1, 1, 1 trichloroethane and the resulting cake was granulated. The granulated I-136 igniter standard was consolidated into 7.62 mm tracer jackets at 2000 pounds force. The projectiles were then spun at 60,000 rpm and ignited by friction. The burn time and output were recorded. A burn time of 2.14 seconds per gram (0.47 grams per second) was obtained with an average burn time in the projectile of 1.97 seconds for seven (7) samples.

A ten (10) gram sample of I-136 igniter was also made without the use of any solvent with the primary ingredients also coming from Lake City AAP to insure that any unusual results would not be due to different qualities of chemicals. This I-136 dry blend igniter was tested the same as the I-136 igniter standard noted above. A burn time of 5.74 seconds per gram (0.174 grams per second) was obtained with an average burn time in the projectile of 4.13 seconds for five (5) samples. The burn characteristics were similar to the I-136 igniter standard.

Initially, nine (9) grams of strontium peroxide were mixed with (a) two (2) grams of IE 70D™ resin and (b) four (4) grams of IE 70D™ resin. The lot with four grams of IE 70D™ resin became too hard and was impossible to granulate although it did burn. The lot with two grams of IE 70D™ resin was easily granulated and, although difficult to ignite, it did burn when consolidated into 7.62 mm tracer jackets using 2000 pounds force when the projectiles were then spun at 60,000 rpm and ignited by friction of a probe.

Since any less than two grams of resin to nine grams of strontium peroxide would not allow the resin to completely coat the oxidizer, small amounts of acetone were added to allow complete coating of the oxidizer. This still allowed the resin to properly cure. Five percent (5%) calcium resinate was added to the strontium peroxide/resin mixture in an effort to achieve more sensitive ignition. However the resulting mixture failed to ignite under testing conditions.

Mixes were then made up in approximately 10 gram samples of 10%, 11%, 12%, and 13% polyurethane (IE 70D™ Resin/Hardener) to 90%, 89%, 88%, and 87% strontium peroxide, respectively, and tested for ignition and burn results. The amounts were weighed on an analytical balance to insure precise measurements. Slightly more Resin than Hardener was used than is otherwise called for since the cure time is a function of the amount of hardener used. This gave plenty of time to blend all the mixes using the same blend of IE 70D™ Resin/Hardener. Although the 11% mixture had too much acetone added and had to be given a longer time to dry, it formed a cake that was easily granulated. The other mixtures were passed through a 20 mesh sieve just prior to hardening to produce a granular, free flowing powder.

These mixtures were consolidated into 7.62 jackets at 3000# force, spun at 60,000 RPM and ignited by friction. All the mixtures performed successfully, although the 12% polyurethane mixture performed ideally with easy ignition, long burn time and low light output while the 11% polyurethane mixture had the least ash residue in the tracer cartridge. An 85% strontium peroxide/15% polyurethane mixture slightly diluted with acetone to ensure a uniform mix was surprising difficult to ignite while spinning during an ignition test.

The preferred method of preparing the polyurethane resin/oxidizer composition is as follows:

1. weigh out the required quantity of strontium peroxide and pass is through a 30 mesh sieve;
2. mix two (2) parts IE 70D™ resin and one (1) part IE 70D™ Hardener by weight;
3. place the strontium peroxide in a blender, such as a Hobart# blender;
4. dilute the IE 70D™ resin mixture with sufficient anhydrous acetone to produce a homogeneous mixture and add this to the strontium peroxide;
5. mix the IE 70D™ resin/strontium peroxide mixture three (3) to five (5) minutes in the blender;
6. place the resulting mixture in an oven at approximately 140° F. until dry;
7. granulate the dried mixture through a 35 mesh sieve; and
8. store the granulated mixture in an airtight conductive container.

The resulting polyurethane resin igniter composition has the proper flowability necessary for the tracer round charging procedure and is water resistant to ensure reliable ignition in adverse moisture conditions. Additionally, polyurethane is available in consistently pure lots so that consistent blending of the proper proportions of polyurethane resin and strontium peroxide is easily achievable, allowing for uniform igniter compositions regardless the lot or batch. The polyurethane resin functions not only as a binder for the strontium peroxide, but also as a fuel allowing for better performing igniter compositions for tracer rounds, for example.

The igniter composition of the present invention has been successfully produced not only in test quantities in the laboratory, but also in production quantities with standard production equipment without any changes or modifications in the production equipment or procedures. The polyurethane resin is easily substituted for the calcium resinate/methyl-chloroform at the production facility at the loading plant without any changes in the amount of igniter composition used or in consolidation pressures. Any polyurethane resin spills have presented no clean-up difficulties and do not require the use of volatile organic solvents for effective clean-ups.

The igniter compositions of the present invention have been charged into 7.62 mm and 5.56 mm tracer projectiles using standard pressures and amounts. Tests have been conducted with these charged tracer projectiles with results that are equal to, if not better than, the standard ammunition. The 7.62 mm projectiles had 100% trace without firing defects in 97 firings. The dim portion of the trace appeared more uniform than the standard ammunition. The 5.56 mm rounds had 1 blind in 100 rounds fired. Again, the dim portion of the trace appeared more uniform than the standard ammunition.

The charging line for 7.62 mm tracer projectiles using the igniter composition of the present invention was the standard line used for the production of standard igniter charged 7.62 mm tracer projectiles. Side by side test firings were conducted with standard igniter charged 7.62 mm tracer projectiles and 7.62 mm tracer projectiles charged with the igniter composition of the present invention. The tests results demonstrated that the 7.62 mm tracer projectiles charged with the igniter composition of the present invention performed better that the standard igniter charged 7.62 mm tracer projectiles.

Barium peroxide, a more vigorous oxidizer was also evaluated using IE 70D™ resin. A five percent (5%) IE 70D™ resin/barium peroxide mixture had a burn rate of 2.55 seconds/gram (0.39 grams/second). This burn rate compares favorably with the I-136 igniter standard burn rate of 2.14 seconds/gram (0.47 grams/second). An advantage of using barium peroxide is that the resulting composition burns without leaving much ash in the tracer cavity which will leave more light output.

Another polyurethane, known as polyurethane 35 (also manufactured by Innovative Engineering of 1541 West Round Lake Road, DeWitt, Mich. 48820), that cures to a less hard state than IE 70D™ resin was used with barium peroxide. Note that the polyurethane 35 and IE 70D™ resins are interchangeable with both strontium peroxide and barium peroxide. Acetone was used to dilute the polyurethane 35 so that it could be incorporated into the barium peroxide. This composition had a burn rate of 1.6 seconds/gram (0.62 grams/second). A six percent (6%) polyurethane 35/barium peroxide mixture displayed a slight flame with greenish overtones on burning. Ignition was difficult with a ten percent (10%) polyurethane 35/barium peroxide composition. It was determined that such compositions having more than six percent polyurethane 35 were difficult to ignite and were not easy to granulate.

A mixture composed of 10 grams of barium peroxide and 0.6 grams polyurethane with sufficient acetone to allow coating of the barium peroxide was shown to be promising. Although this mixture could not, by itself, ignite a tracer mixture, it could ignite I-280 (a mixture of 15% magnesium and 85% I-136) which in turn ignited a tracer mixture.

The following table summarizes the results of the various compositions tested:

| Composition | Burn time/ rate (sec/g) | Projectile burn time (seconds) | Remarks |
|---|---|---|---|
| 1. Standard I-136 | 2.14 | 1.97 | Used as baseline |
| 2. Dry blended I-136 | 5.74 | 4.13 | I-136 without methyl-chloroform |

3. Substitutions for Standard I-136 calcium resinate binder:
a.) 10% ethyl cellulose -continued

| Composition | Burn time/ rate (sec/g) | Projectile burn time (seconds) | Remarks |
|---|---|---|---|
| i.) dry blended | — | — | more difficult to ignite and burned with more flame than Standard I-136 |
| ii.) blended with isopropyl alcohol | — | — | more difficult to ignite and burned with more flame than Standard I-136 |
| b.) gelatin | — | — | ineffective |
| c.) melamine | — | — | ineffective - very difficult to ignite |
| d.) carboxy methyl cellulose | | | |
| i.) dry blended | — | — | undesired bright flame |
| ii.) blended with water | — | — | failed to ignite |
| 4. Substitutions for Standard I-136 methyl-chloroform solvent: | | | |
| a.) acetone | — | — | unsatisfactory |
| b.) isopropyl alcohol | — | — | unsatisfactory |
| c.) 50/50 mixture of acetone and isopropyl alcohol | — | — | unsatisfactory |
| 5. Use of polyurethane substitutes for calcium resinate binder (with anhydrous acetone solvent) | | | |
| WITH STRONTIUM PEROXIDE OXIDIZER: | | | |
| a.) 9 g strontium peroxide/2 g IE 70D ™ resin | — | — | easily granulated but difficult to ignite although it would burn in 7.62 mm tracer jacket |
| b.) 9 g strontium peroxide/4 g IE 70D ™ resin | — | — | too hard - could not granulate |
| c.) 5% calcium resinate added to strontium peroxide/IE 70D ™ resin | — | — | failed to ignite |
| d.) Additional strontium peroxide/IE 70D ™ resin compositions: | | | |
| $SrO_2$ IE 70D ™ | | | |
| 90% 10% | — | — | successful |
| 89% 11% | — | — | successful - least ash residue |
| 88% 12% | — | — | performed ideally - easy ignition, long burn time and low light output |
| 87% 12% | — | — | successful |
| 85% 15% | — | — | unsuccessful - surprisingly difficult to ignite |
| WITH BARIUM PEROXIDE OXIDIZER: | | | |
| a.) 95% $BaO_2$/ 5% IE 70D ™ resin | 2.55 | — | favorably burn time compared to Standard I-136; less ash in tracer cavity |
| b.) Additional polyurethane 35 resin compositions: | | | |
| $BaO_2$ poly. 35 | | | |
| 94% 6% | 1.6 | — | slight flame with greenish overtones upon burning |
| 90% 10% | | — | ignition difficult |
| <94% >6% | | — | difficult to ignite and easily granulated |
| 10 g 0.6 g | | — | promising - unable to ignite tracer mixture by itself but could ignite I-280 which in turn would ignite tracer mixture |

While particular embodiments of the present invention have been illustrated and described, it is not intended to limit the invention, except as defined by the following claims.

We claim:

1. Granulated igniter composition comprising an oxidizer selected from the group consisting of strontium peroxide and barium peroxide, said oxidizer being dispersed in a polyurethane resin.

2. The igniter composition of claim 1, wherein said granulated igniter is blended with an amount of powdered magnesium.

3. The igniter composition of claim 1, wherein the amount of polyurethane resin is approximately 10 to 14 parts by weight and the amount of strontium peroxide is approximately 90 to 86 parts by weight.

4. The igniter composition of claim 3, wherein the amount of polyurethane resin is 12 parts by weight and the amount of strontium peroxide is 88 parts by weight.

5. The igniter composition of claim 1, wherein the amount of polyurethane resin is approximately 5 parts by weight and the amount of barium peroxide is approximately 95 parts by weight.

6. An igniter composition, comprising:

approximately 90 to 86 parts strontium peroxide by weight dispersed in approximately 10 to 14 parts polyurethane resin by weight, said resin is cured at room temperature and the igniter composition is granulated to form a granulated igniter.

7. The igniter composition of claim 6, wherein the amount of strontium peroxide is 88 parts by weight and the amount of polyurethane resin is 12 parts by weight.

8. The igniter composition of claim 6, wherein said granulated igniter is blended with an amount of powdered magnesium.

9. Method for the preparation of a granulated igniter composition which comprises the steps of (a) dispersing an oxidizer selected from the group consisting of strontium peroxide and barium peroxide in an uncured polyurethane resin, (b) curing said resin to form an igniter, and (c) granulating the igniter.

10. The method of claim 9, further including the step of:

blending said granulated igniter with an amount of powdered magnesium.

11. The method of claim 9, wherein the amount of polyurethane resin is approximately 10 to 14 parts by weight and the amount of strontium peroxide is approximately 90 to 86 parts by weight.

12. The method of claim 9, wherein the amount of polyurethane resin is 12 parts by weight and the amount of strontium peroxide is 88 parts by weight.

13. The method of claim 9, wherein the amount of polyurethane resin is approximately 5 parts by weight and the amount of barium peroxide is approximately 95 parts by weight.

14. An igniter composition, comprising:

approximately 95 parts barium peroxide by weight dispersed in approximately 5 parts polyurethane resin by weight, said resin is cured at room temperature and the igniter composition is granulated to form a granulated igniter.

* * * * *